US008357892B2

(12) United States Patent
Suyama et al.

(10) Patent No.: US 8,357,892 B2
(45) Date of Patent: Jan. 22, 2013

(54) MASS SPECTROMETER

(75) Inventors: Motohiro Suyama, Hamamatsu (JP); Etsuo Iizuka, Hamamatsu (JP); Akio Suzuki, Hamamatsu (JP); Hiroshi Kobayashi, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 241 days.

(21) Appl. No.: 12/730,475

(22) Filed: Mar. 24, 2010

(65) Prior Publication Data

US 2010/0243887 A1 Sep. 30, 2010

(30) Foreign Application Priority Data

Mar. 31, 2009 (JP) ..... P2009-084735

(51) Int. Cl.
*H01J 49/40* (2006.01)

(52) U.S. Cl. ..... 250/287; 250/281; 250/282; 250/283; 313/103 CM; 313/105 CM

(58) Field of Classification Search ..... 250/397, 250/287, 283, 281, 282; 313/103 CM, 105 CM
See application file for complete search history.

(56) References Cited

U.S. PATENT DOCUMENTS

| | | | | |
|---|---|---|---|---|
| 6,828,729 | B1 * | 12/2004 | Owens et al. | 313/528 |
| 6,958,474 | B2 * | 10/2005 | Laprade et al. | 250/287 |
| 7,564,043 | B2 * | 7/2009 | Hayashi et al. | 250/397 |
| 2009/0236517 | A1 * | 9/2009 | Suzuki et al. | 250/287 |

FOREIGN PATENT DOCUMENTS

JP 2007-87885 4/2007

* cited by examiner

*Primary Examiner* — Nikita Wells
*Assistant Examiner* — Johnnie L Smith
(74) *Attorney, Agent, or Firm* — Drinker Biddle & Reath LLP

(57) ABSTRACT

A mass spectrometer that allows easy replacement of an MCP (microchannel plate) and is enabled to secure orthogonality between an incident surface of the MCP and an ion track at high accuracy is provided. A flight tube 2 where ions fly is arranged in a vacuum vessel composed of a vacuum flange 6 and a body 1, and an MCP group 4 is attached to a tail end of the flight tube 2 via an MCP-IN electrode 3. A vacuum flange 6 is attachably and detachably attached to the body 1, and the MCP group 4, by a spring 710 provided on a circuit board 7 for detection attached to the vacuum flange 6, is urged toward an end portion of the flight tube 2 so that its orthogonality with respect to an ion flight track is secured.

8 Claims, 15 Drawing Sheets

MASS SPECTROMETER

BACKGROUND OF THE INVENTION

1. Field of the Invention

The present invention relates to a time-of-flight mass spectrometer (TOF-MS) used for detection of the molecular weight of a polymer and the like.

2. Related Background Art

In a TOF-MS, the mass of detecting ions is detected based on time required for the detecting ions to fly within a vacuum flight tube. An apparatus of a type disclosed in JP2007-87885A has been known as a charged-particle detecting apparatus to be used as a detector in such a TOF-MS.

This charged-particle detecting apparatus has a detecting section including a microchannel plate (MCP) arranged on a vacuum flange, and thus has a configuration that makes it easy to replace the MCP when the detector reaches its life end.

SUMMARY OF THE INVENTION

Meanwhile, in the TOF-MS, a mass detection accuracy of detecting ions depends on a detection accuracy of a time of flight, that is, a half-value width of an output signal to be output when the ions have reached an ion incident surface of the detector. Recently, a particularly high detection accuracy has been demanded, and a demanded half-value width of an output signal of ions is 1 ns or less. A flight track of ions in the flight tube is in a direction almost along the direction in which the flight tube extends, and orthogonality with respect to this direction of the ion incident surface of the detector is demanded. This is because, if the ion incident surface has an inclination, the length of a flight track differs depending on the position of the ion incident surface, which affects the detection accuracy of a time of flight. It is necessary in order to satisfy the half-value width condition of an output signal of ions described above to arrange the ion incident surface so that a difference in flight distance is within ±20 μm.

Because an incident surface of the MCP to serve as an ion incident surface is fixed to the flight tube via the vacuum flange in the technique described in the above-mentioned document, it is difficult to secure orthogonality between an ion track and the MCP incident surface.

It is therefore an object of the present invention to provide a mass spectrometer that allows easy replacement of an MCP and is enabled to secure orthogonality between an incident surface of the MCP and an ion track at high accuracy.

In order to achieve the above-mentioned object, a mass spectrometer according to the present invention is a mass spectrometer that, based on time required for ions emitted from a sample to fly within a flight tube being a vacuum vessel in an apparatus body, analyzes a mass of the ions, including: an MCP arranged in the vacuum vessel at an ion reaching side of the flight tube, for outputting electrons in response to reached ions, the MCP being directly fixed with the apparatus body by an input-side electrode electrically and physically connected to its ion reaching surface side; a flange portion attachably and detachably connected and fixed to an ion reaching-side end portion of the flight tube to form the vacuum vessel, and having a signal output terminal and a potential supply terminal exposed on an outer surface of the vacuum vessel; an anode portion fixed onto the flange portion to face the MCP, being input with electrons output from the MCP, and electrically connected to the signal output terminal; and output-side electrode urging means fixed to the flange portion to urge an output side surface of the microchannel plate for electrically connecting the output side electrode of the microchannel plate and the potential supply terminal to each other.

The MCP is preferably fixed to the flight tube via the input-side electrode. This MCP is preferably stacked up in a plurality of stages. It is preferable that the mass spectrometer further includes input-side electrode urging means fixed to the flange portion to urge the input-side electrode for electrically connecting the input-side electrode and an electric power input terminal provided on the flange portion to each other.

It may be preferable that the mass spectrometer further includes an electron multiplier section arranged on the MCP side further than the anode, and fixed to the flange portion. For the output-side electrode urging means, a spring, conductive rubber, a metal projection, and the like are preferably used.

In the mass spectrometer according to the present invention, because the MCP having an ion incident surface is directly fixed to a vacuum vessel body by the input-side electrode, it is easy to secure orthogonality between the ion incident surface and an ion track, and replacement of the MCP is also easy.

Further, if in a mode of fixation to a flight tube end portion, the accuracy of orthogonality between the ion incident surface and an ion track depends on the accuracy of orthogonality of the end portion in the flight tube, so that it becomes easy to secure the accuracy of the MCP.

DESCRIPTION OF THE PREFERRED EMBODIMENTS

Figure 1:
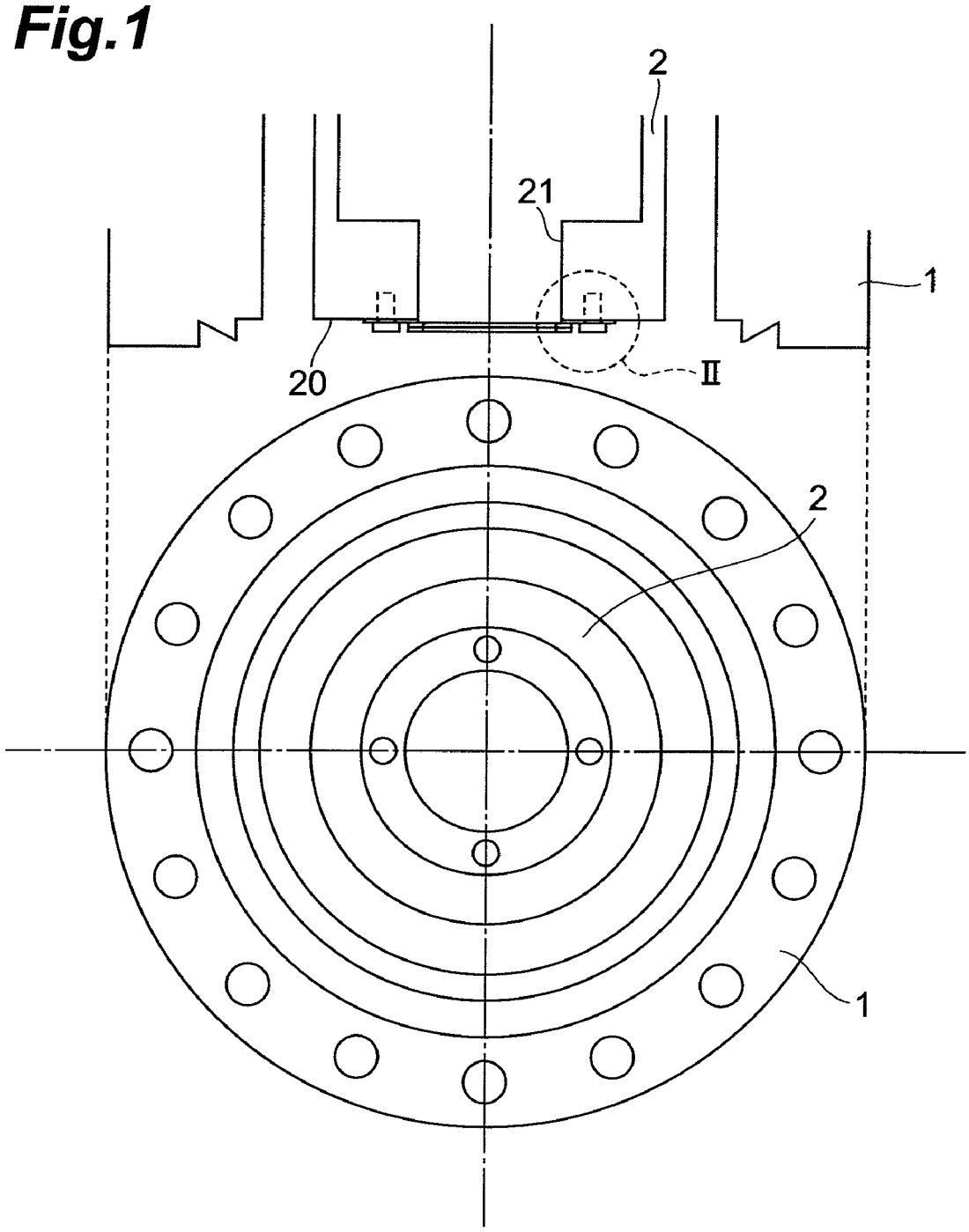
FIG. 1 is a view showing a structure of a flight tube end portion in a first embodiment of a mass spectrometer according to the present invention.

Hereinafter, preferred embodiments of the present invention will be described in detail with reference to the accompanying drawings. To facilitate the comprehension of the explanation, the same reference numerals denote the same parts, where possible, throughout the drawings, and a repeated explanation will be omitted.

Figure 2:
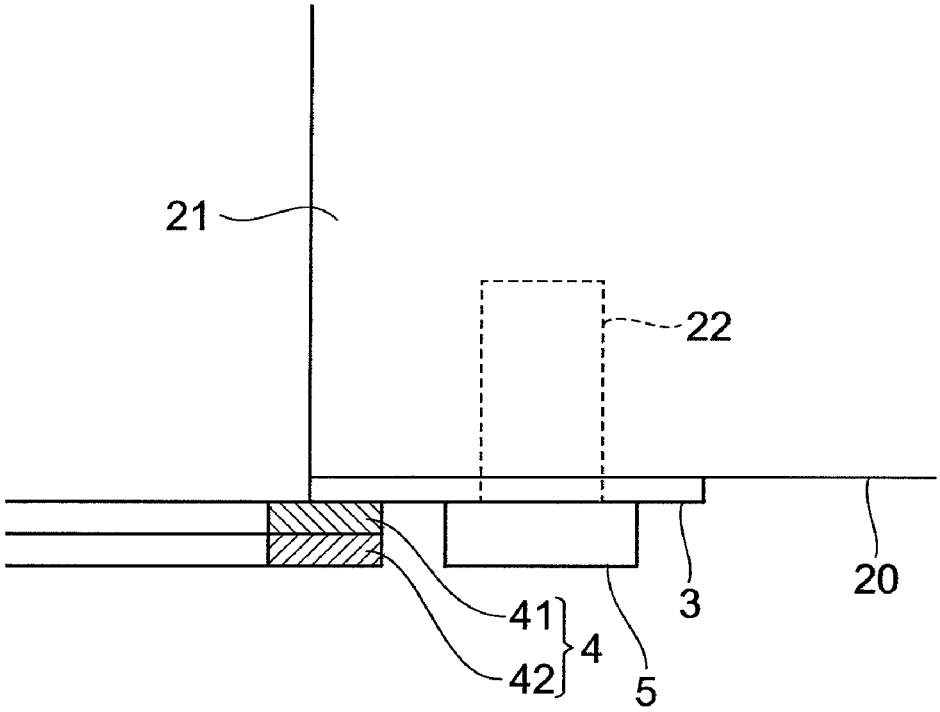
FIG. 2 is an enlarged view of a II part thereof.
Figure 3:
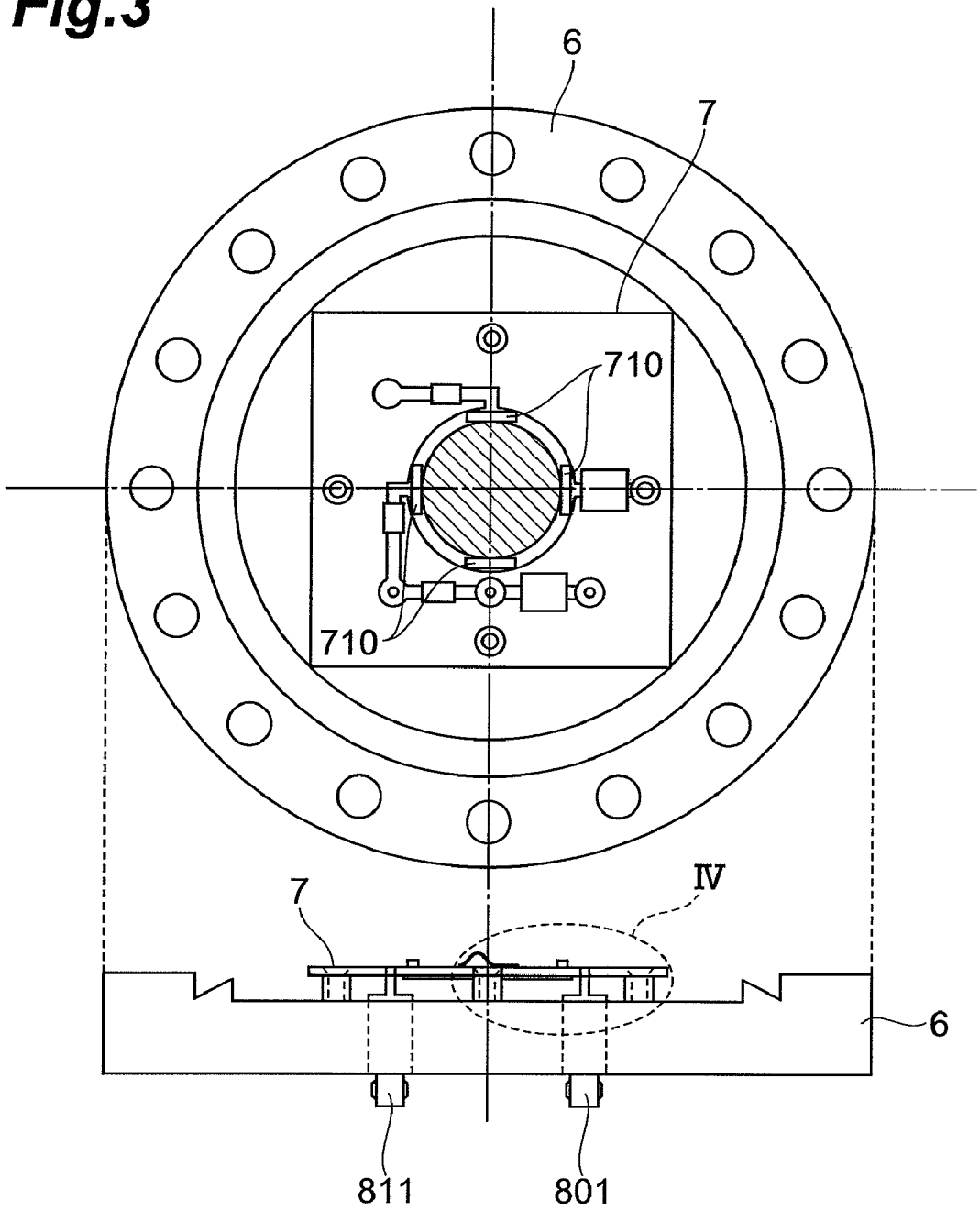
FIG. 3 is a view showing a structure of a vacuum flange of FIG. 1.
Figure 4:
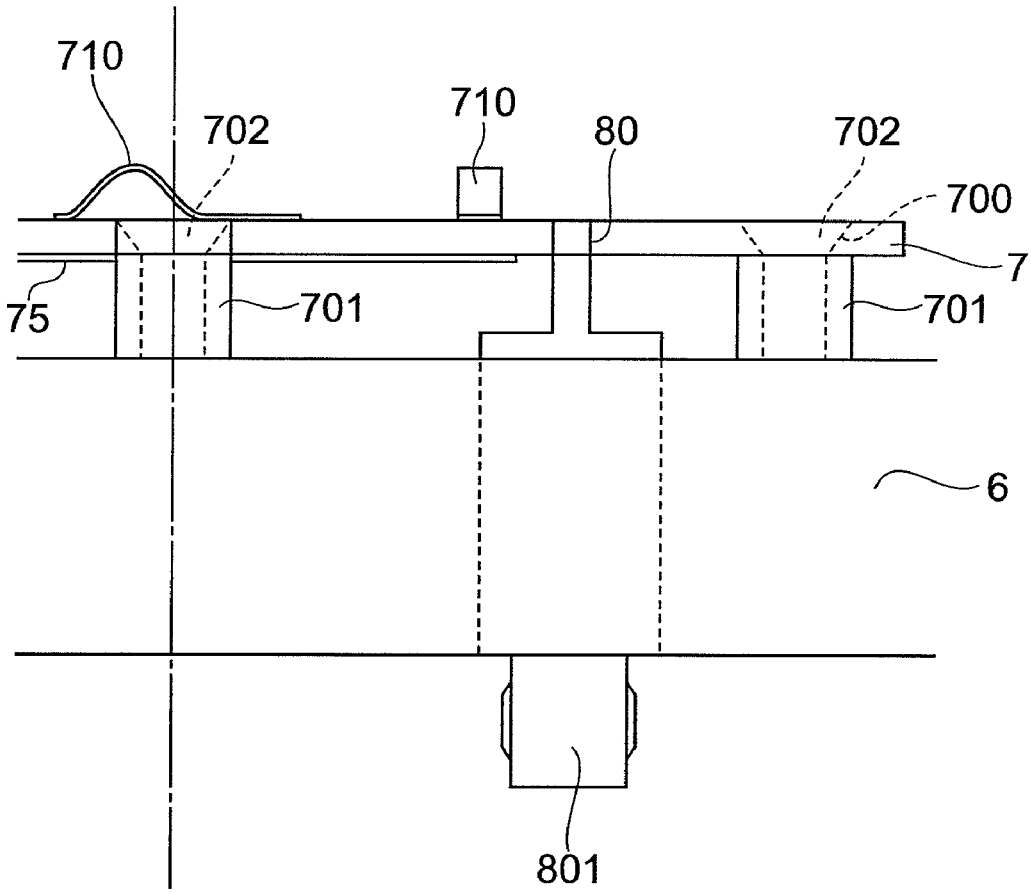
FIG. 4 is an enlarged view of a IV part thereof.
Figure 5:
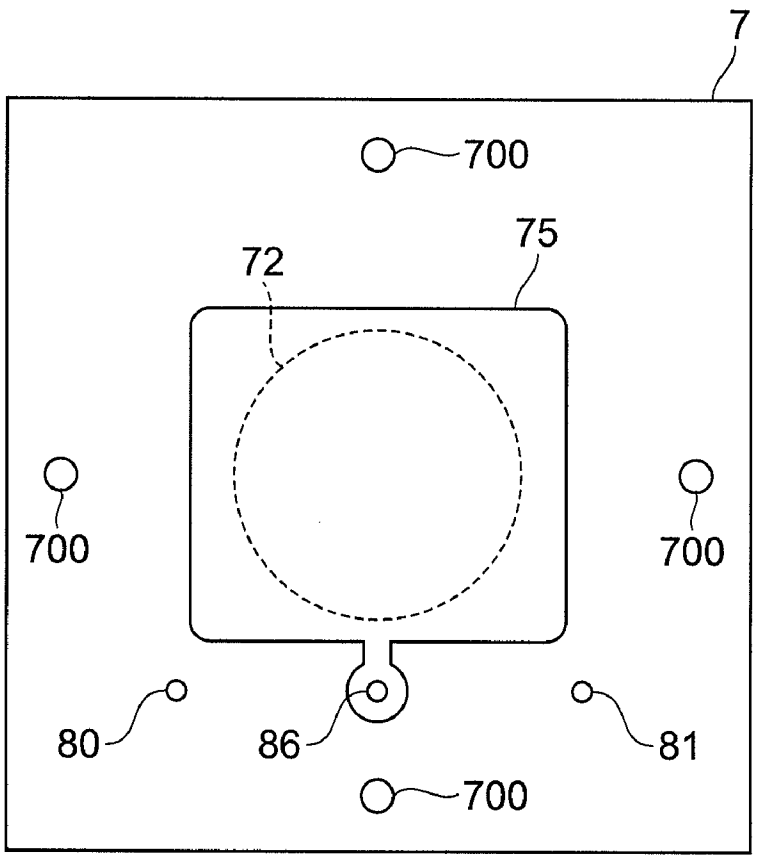
FIGS. 5(*a*) and (*b*) are views showing a structure of a circuit board to be arranged on the vacuum flange of FIG. 3.
Figure 5:
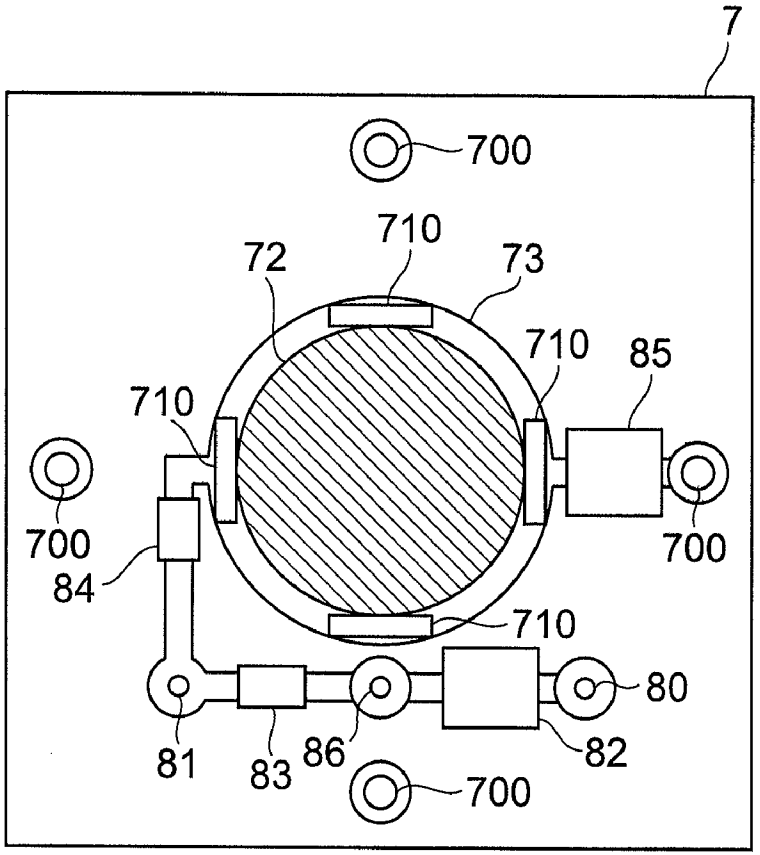
Figure 6:
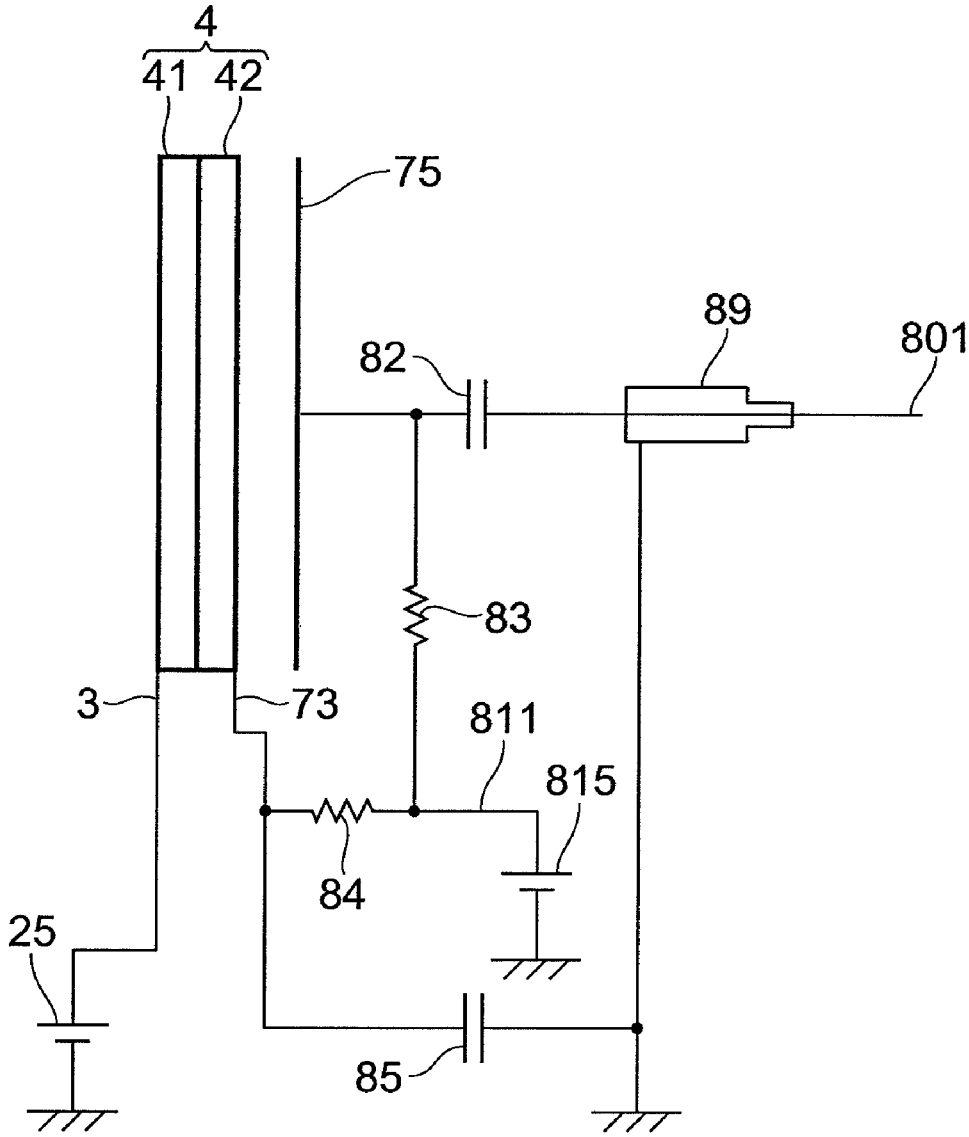
FIG. 6 is a view showing an equivalent circuit of the mass spectrometer according to the present invention.
Figure 7:
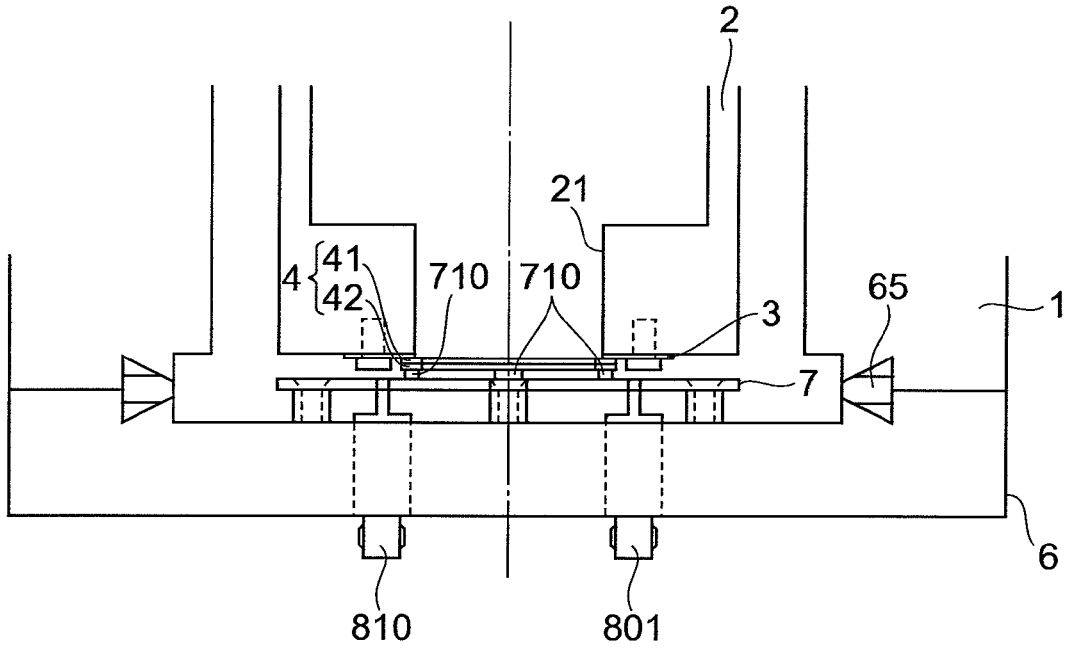
FIG. 7 is a view showing a state of the flight tube shown in FIG. 1 and the vacuum flange shown in FIG. 3 having been assembled.

FIG. 1 is a view showing a structure of a flight tube end portion in a first embodiment of a mass spectrometer according to the present invention, FIG. 2 is an enlarged view of a II part thereof, FIG. 3 is a view showing a structure of a vacuum flange, FIG. 4 is an enlarged view of a IV part thereof, FIG. 5 are views showing a structure of a circuit board, FIG. 6 shows an equivalent circuit thereof, and FIG. 7 shows an assembled state.

The flight tube 2 is a cylindrical structure to be arranged in a body 1 of the mass spectrometer. At its end portion of a side that has not been illustrated, an ion source is arranged. On the other hand, at the illustrated end portion, two disk-like MCPs 41 and 42 (hereinafter, collectively referred to as an MCP group 4) are arranged. The MCPs 41 and 42 are bonded to each other by a conductive thermoplastic adhesive, and further, an MCP-IN electrode 3 formed of an annular metal is bonded to an MCP 41-side surface by the same conductive thermoplastic adhesive. Then, by arranging the MCP-IN electrode 3 on an end face 20 of the flight tube 2, and inserting and fixing by screwing screws 5 passed through a plurality of holes (preferably, three or more holes, and four holes are arranged in the present embodiment) provided in the electrode 3 into screw holes 22 provided in the flight tube 2, the electrode 3 is fixed to the flight tube 2. Thus, the flight tube 2 and the MCP-IN electrode 3 are electrically and physically connected to each other.

The vacuum flange 6, which is a disk-like metal member, is attached to an end portion of the body 1 surrounding a circular cylindrical portion of the flight tube 2 across a gasket 65 (see FIG. 7) so as to be attachable and detachable with respect to the flight tube 2. The body 1 and the vacuum flange 6, which compose a vacuum vessel, keep the inside of a space to be thereby sealed in a vacuum so as to keep a portion including an ion flight track in the flight tube 2 in a vacuum. On a surface to be arranged inside of the vacuum vessel of the vacuum flange 6, a substrate 7 retaining an anode 75 is arranged.

The substrate 7, which is, for example, a rectangular plate made of polyimide, is provided with a screw hole 700 at an outer edge portion close to an intermediate portion of each side, and fixed to the vacuum flange 6, across an insulating and circular cylindrical insulator 701, by a screw 702 passing through the screw hole 700. Thus, a space is secured between the substrate 7 and the vacuum flange 6 and both are electrically connected to each other so as to ground the substrate 7.

The substrate 7 has a circular cutout 72 in its center, and is attached, at its rear surface (surface to be arranged on the vacuum flange 6 side), with the anode 75 formed of a plate-like metal. The anode 75 is electrically and physically connected to an anode terminal 86 to be described later by bonding using a conductive adhesive, resistance welding, or soldering, and fixedly fitted to the substrate 7. Moreover, the substrate 7 is mounted thereon with a bleeder circuit formed of resistors 83, 84 and capacitors 82, 85, and has an output terminal 80, a power supply terminal 81, and an anode terminal 86 as connection terminals of this circuit.

The power supply terminal 81 is connected to a high voltage terminal 811 passing through the vacuum flange 6, and supplied with power from an external power supply 815 connected to the terminal 811. On the other hand, the output terminal 80 is connected with an an SMA (Sub Miniature Type A) terminal 801 passing likewise through the vacuum flange 6, and readout from a connected external device is enabled. On the substrate 7 surrounding the cutout 72, an annular MCP-OUT electrode 73 formed by a copper foil pattern is provided, and on the MCP-OUT electrode 73, four springs 710 are attached by resistance welding. When the vacuum flange 6 is attached, these springs 710 urge the MCP group 4 to apply a stress to these, and are electrically connected to the MCP group 4 to supply potential.

As a result of providing such a configuration, the MCP group 4 is pressed against an ion output-side end face of the flight tube 2 by the springs 710, and therefore, it becomes easy to secure parallelism between an input surface of the MCP group 4 (more concretely, an incident surface of the input-side MCP 41) and the output-side end face of the flight tube 2 at high accuracy. Accordingly, securing in advance orthogonality of the output-side end face of the flight tube 2 to an ion flight track in manufacturing makes it easy to secure orthogonality between the ion flight track and the incident surface of the MCP 41 at high accuracy. Concretely, it suffices to secure the accuracy of orthogonality of the end face with respect to a central axis of the flight tube 2 and make a contrivance to have a difference in flight distance within ±10 μm.

At the time of operation, a predetermined potential is applied, through the terminal 811 from the external power supply 815, to both ends of the MCP group 4 and the anode 75, and the vacuum flange 6 is provided at ground potential. At detection of cations, it suffices to apply a voltage of −5 kV from a power supply 25 of the flight tube 2 side and −2.9 kV from the power supply 815 of the vacuum flange 6 side. On the other hand, at detection of anions or electrons, it suffices to apply a voltage of 5 kV from the power supply 25 of the flight tube 2 side and 7.1 kV from the power supply 815 of the vacuum flange 6 side, respectively.

According to the present embodiment, because orthogonality of the incident surface of the MCP group 4 with respect to the ion flight track in the flight tube 2 can be secured at high accuracy, a narrow half-value width of an output signal of ions of 2 ns or less can be obtained. On the other hand, with regard to parallelism between an output surface of the MCP group 4 and the anode 75, because the flying speed of electrons is sufficiently fast, as high an accuracy as the accuracy for orthogonality of the MCP group 4 is not required, and almost no effect occurs on the half-value width of an output signal of ions even at an accuracy of about ±100 μm. Accordingly, replacement of the MCP group 4 and detector can also be easily performed by attachment and detachment of the vacuum flange 6.

The method for attaching the MCP group 4 is not limited to that of the above-mentioned embodiment. In the following, description will be given of other embodiments where the attaching method is different.

Figure 8:
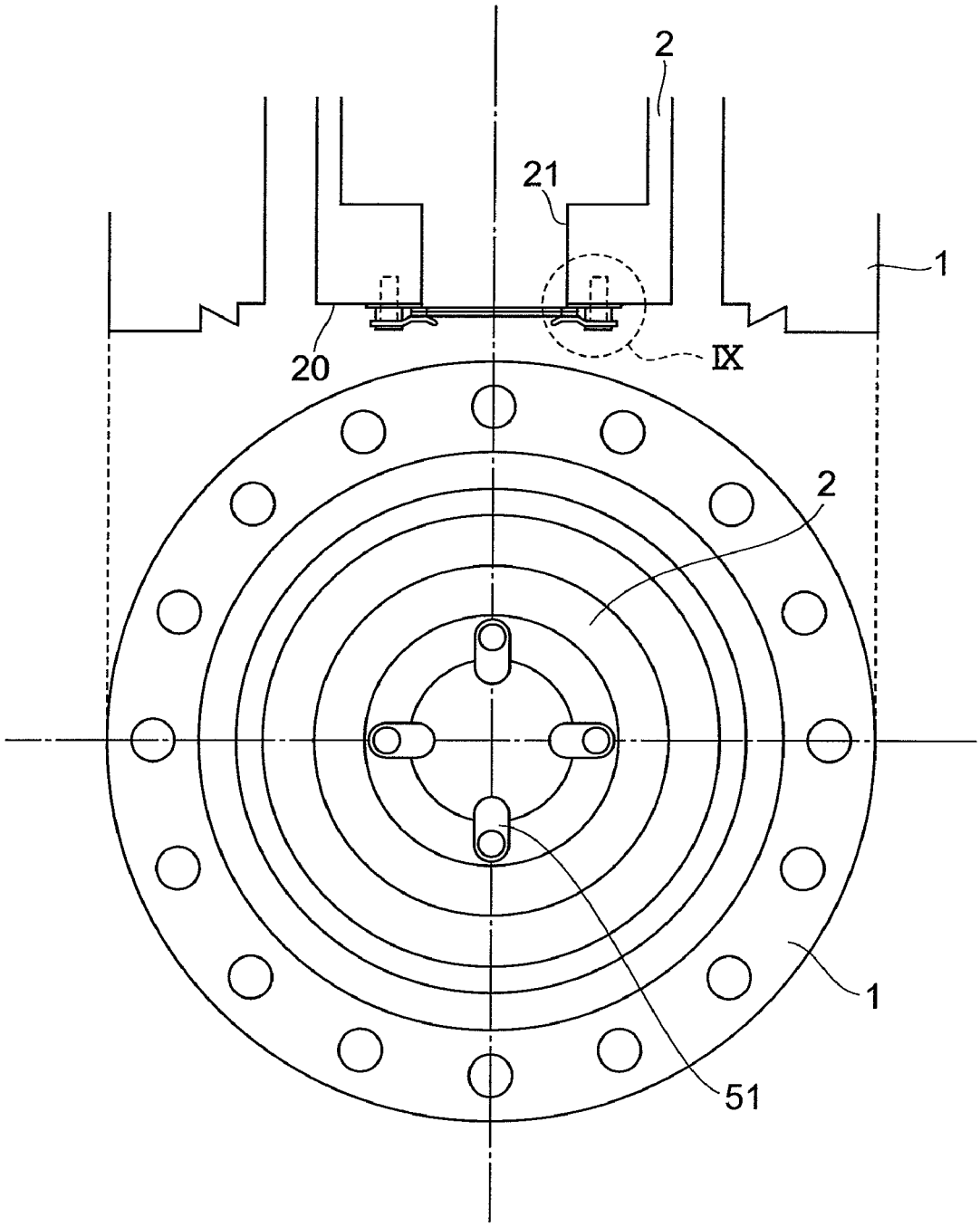
FIG. 8 is a view showing a structure of a flight tube end portion in a second embodiment of a mass spectrometer according to the present invention.
Figure 9:
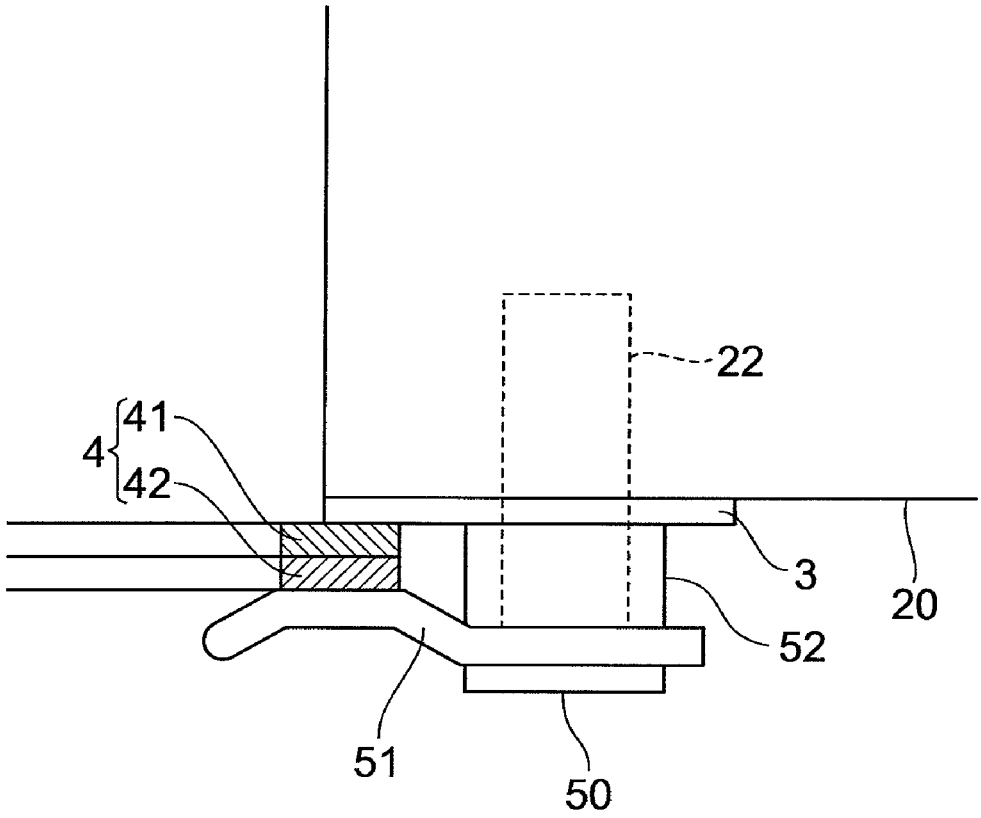
FIG. 9 is an enlarged view of a IX part thereof.

In the second embodiment shown in FIG. 8 and FIG. 9, an insulator 52 being a circular cylindrical insulator is arranged on a through-hole for a screw provided in the MCP-IN electrode 3, a hooked clamp 51 is thereon arranged, and by fixing the clamp 51, the insulator 52, and the MCP-IN electrode 3 with a screw 50 screwed in a screw hole of the flight tube 2, the MCP group 4 is fixed. The screw 50 is an insulating screw formed of a PEEK (polyetheretherketone) resin or a Teflon resin, and the clamp 51 and the MCP group 4 are separated in potential from each other.

Figure 10:
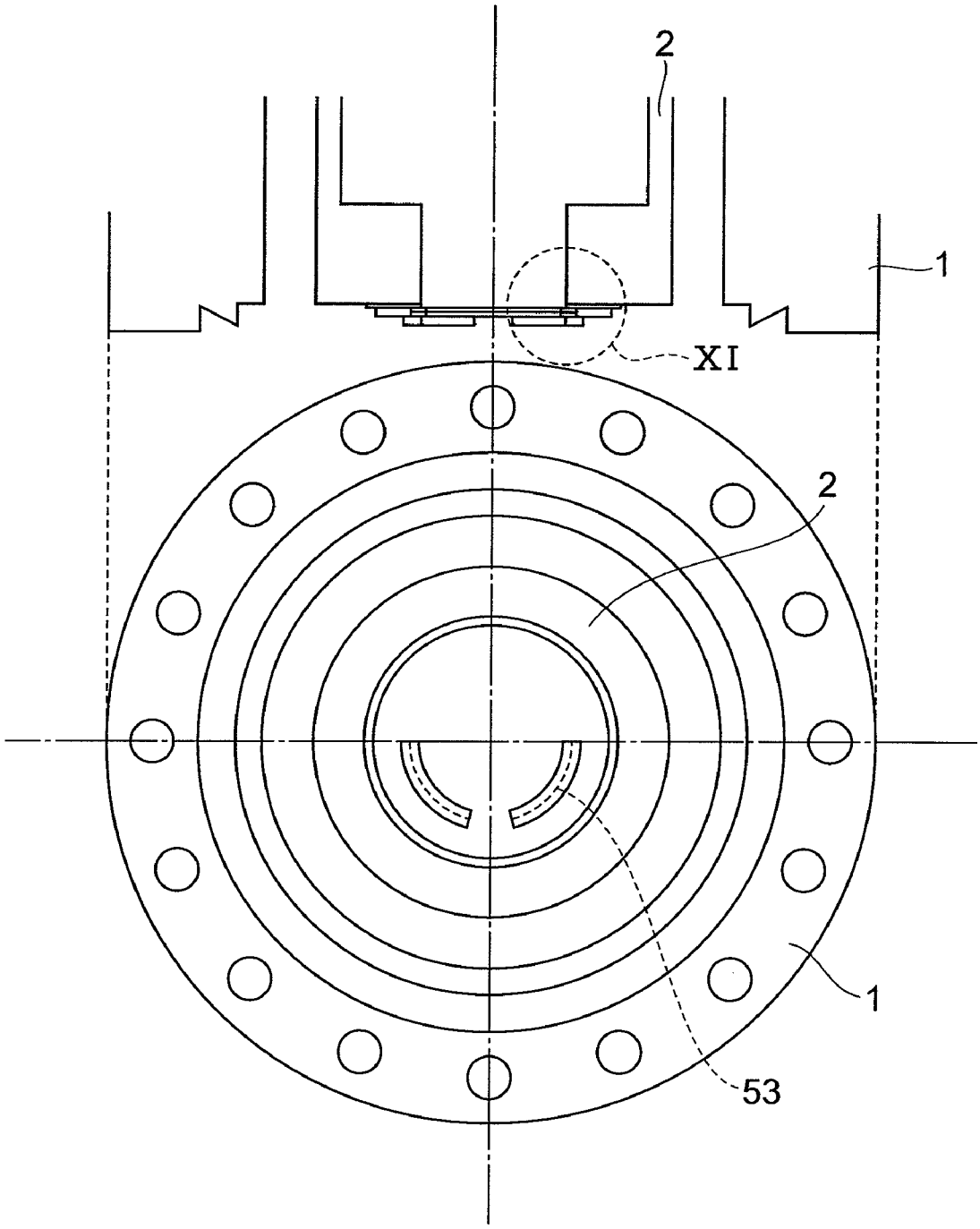
FIG. 10 is a view showing a structure of a flight tube end portion in a third embodiment of a mass spectrometer according to the present invention.
Figure 11:
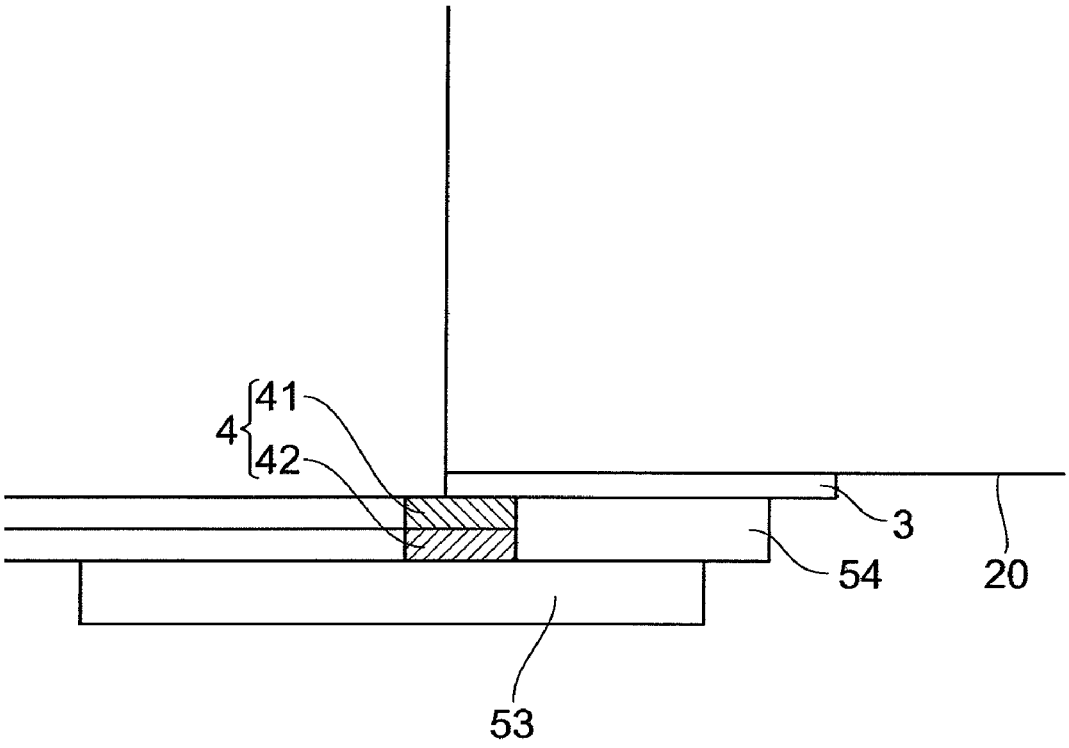
FIG. 11 is an enlarged view of an XI part thereof.
Figure 12:
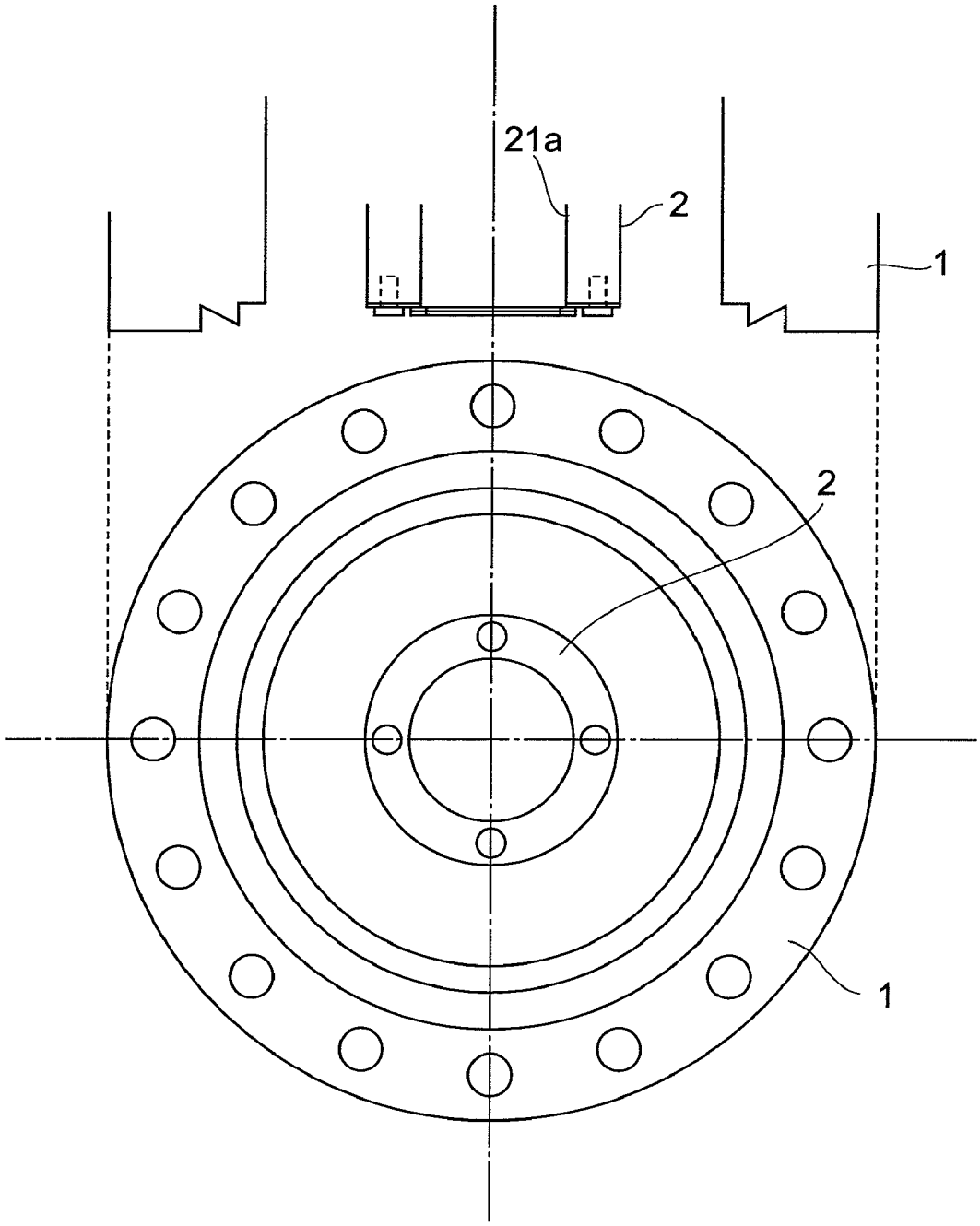
FIG. 12 is a view showing a structure of a flight tube end portion in a fourth embodiment of a mass spectrometer according to the present invention.

In the third embodiment shown in FIG. 10 and FIG. 11, the MCP-IN electrode 3 is fixedly fitted at an end portion of the flight tube 2 by bonding, welding, or the like, and thereon attached via an arc-shaped insulator 54 is a fixing plate 53 formed of a metal plate which is likewise in an arc shape, by an adhesive or the like. The MCP group 4 is arranged inserted in a groove part formed between the fixing plate 53 and the MCP-IN electrode 3. In this case as well, the fixing plate 53 and the MCP group 4 are separated in potential from each other.

It becomes possible also in these second and third embodiments as in the first embodiment to secure orthogonality of the incident surface of the MCP group 4 with respect to the ion flight track in the flight tube 2 at high accuracy. Moreover, in these embodiments, there is also an advantage that only the MCP group 4 can be easily replaced.

Figure 13:
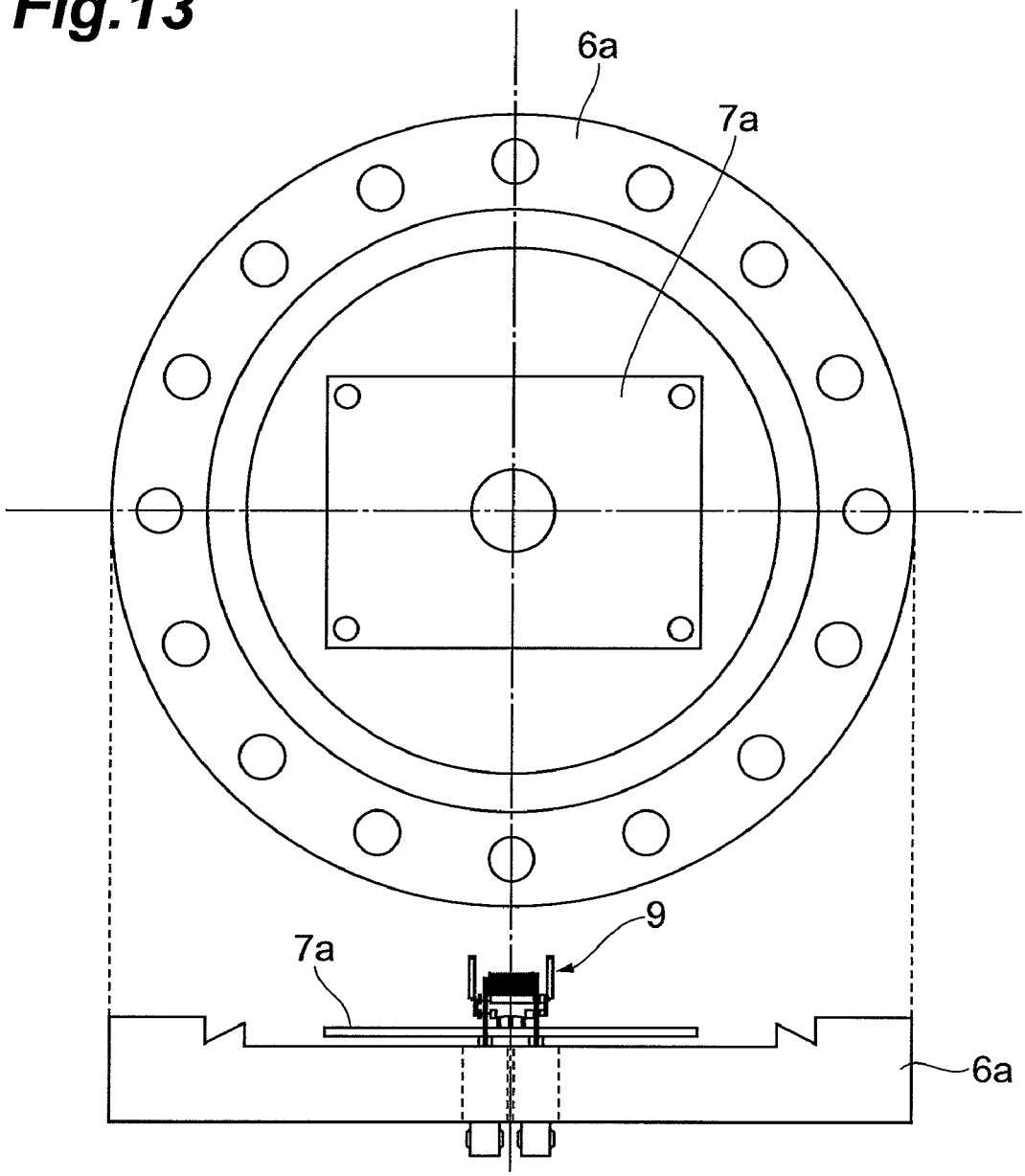
FIG. 13 is a view showing a structure of a vacuum flange thereof.
Figure 14:
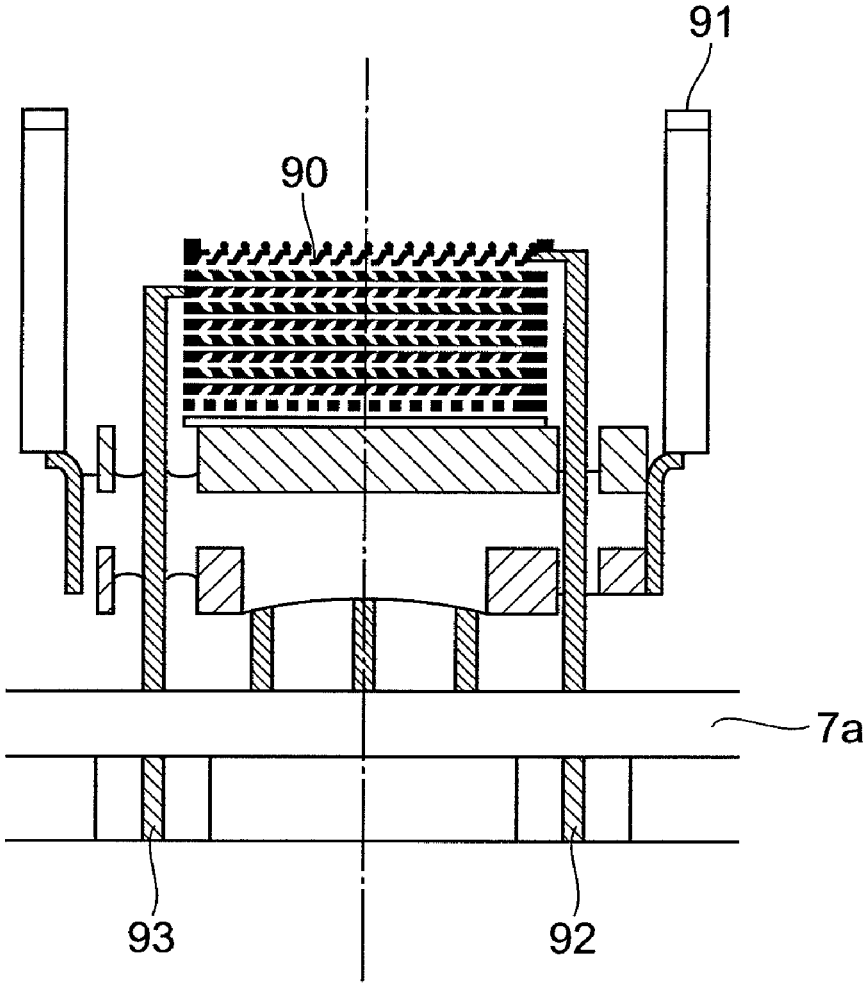
FIG. 14 is an enlarged sectional view of an electron multiplier section thereof.
Figure 15:
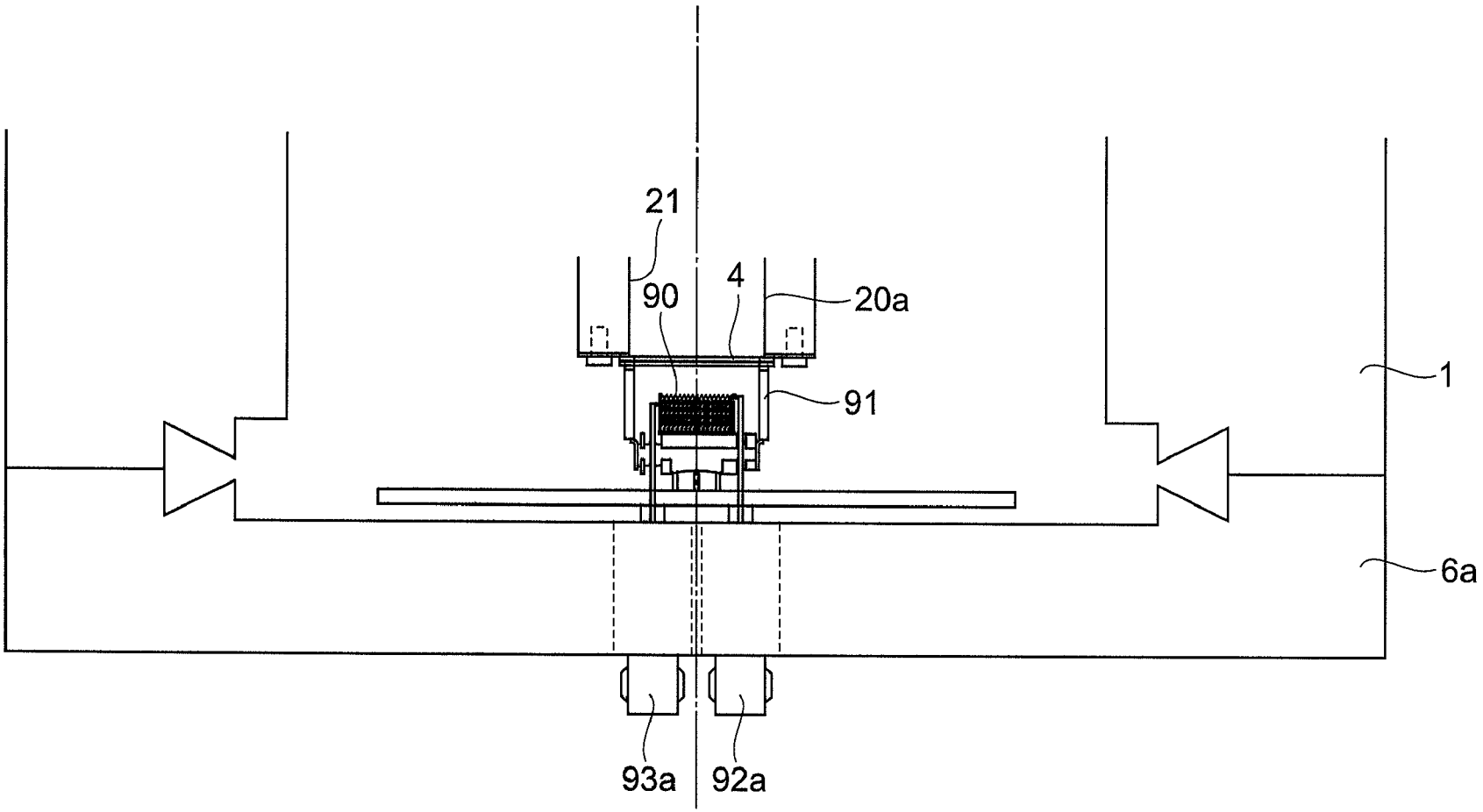
FIG. 15 is a view showing a state of the flight tube shown in FIG. 12 and the vacuum flange shown in FIG. 13 having been assembled.

The configuration of the detector side is also not limited to that shown in the first embodiment. For example, as shown in FIG. 13 to FIG. 15, a configuration arranging a metal channel dynode (MCD) 90 on a substrate 7*a* on a vacuum flange 6*a* and urging the MCP group 4 by a spring 91 may be adopted. In this case, a connection with an external device is performed by using terminals 93*a* and 92*a* connected to an input terminal 93 and an output terminal 92, respectively, that are connected to the MCD 90.

The above embodiments can be appropriately modified. For example, in the first embodiment, the MCP group 4 has been urged by the springs 710 provided on the substrate 7, however, springs may be provided between the substrate 7 and the vacuum flange 6 so as to urge the MCP group 4 indirectly by the substrate 7 urged by the springs or by another member.

Although, in the above, a description has been given of an example of supplying the MCP-IN electrode 3 with potential from the flight tube 2 side, it may be possible, as in the case of an MCP-OUT electrode, to secure a path to electrically perform a connection using conductive urging means or the like from the vacuum flange 6 side. In this case, there is an advantage that an electrical connection can be performed entirely on an exposed surface of the vacuum flange 6.

Moreover, the fixing position of the input side of the MCP group 4 is not limited to the end face of the flight tube 2, and for example, a form of fixation to an end face part of the body 1 surrounding the flight tube 2 may be adopted. Moreover, for the urging means, conductive rubber, a metal projection, and the like can be used besides the metal spring.

What is claimed is:

1. A mass spectrometer that, based on time required for ions emitted from a sample to fly within a flight tube being a vacuum vessel in an apparatus body, analyzes a mass of the ions, comprising:

a microchannel plate arranged in the vacuum vessel at an ion reaching side of the flight tube, for outputting electrons in response to reached ions, the microchannel plate being directly fixed with the apparatus body by an input-side electrode electrically and physically connected to its ion reaching surface side;

a flange portion attachably and detachably connected and fixed to an ion reaching-side end portion of the flight tube to form the vacuum vessel, and having a signal output terminal and a potential supply terminal exposed on an outer surface of the vacuum vessel;

an anode portion fixed onto the flange portion to face the microchannel plate, being input with electrons output from the microchannel plate, and electrically connected to the signal output terminal; and an output-side electrode urging means fixed to the flange portion to urge an output side surface of the microchannel plate for electrically connecting the output side electrode of the microchannel plate and the potential supply terminal to each other.

2. The mass spectrometer according to claim 1, wherein the microchannel plate is fixed to an ion reaching-side end face of the flight tube via the input-side electrode.

3. The mass spectrometer according to claim 1, wherein the microchannel plate is stacked up in a plurality of stages.

4. The mass spectrometer according to claim 1, further comprising input-side electrode urging means fixed to the flange portion to urge the input-side electrode for electrically connecting the input-side electrode and an electric power input terminal provided on the flange portion to each other.

5. The mass spectrometer according to claim 1, further comprising an electron multiplier section arranged on the microchannel plate side further than the anode, and fixed to the flange portion.

6. The mass spectrometer according to claim 1, wherein the output-side electrode urging means is a spring.

7. The mass spectrometer according to claim 1, wherein the output-side electrode urging means is made of conductive rubber.

8. The mass spectrometer according to claim 1, wherein the output-side electrode urging means is a metal projection.

* * * * *